US007500592B1

(12) United States Patent
Petricio Yaksic

(10) Patent No.: US 7,500,592 B1
(45) Date of Patent: Mar. 10, 2009

(54) STORAGE TANK CONSTRUCTION

(76) Inventor: Davor Petricio Yaksic, La Colpa 681, Sector la Chimba, Casilla 902, Antofagasta (CL)

( * ) Notice: Subject to any disclaimer, the term of this patent is extended or adjusted under 35 U.S.C. 154(b) by 541 days.

(21) Appl. No.: 11/165,301

(22) Filed: Jun. 24, 2005

(51) Int. Cl.
*B23K 31/02* (2006.01)

(52) U.S. Cl. ..... 228/184

(58) Field of Classification Search ..... 228/101, 228/212, 213, 184
See application file for complete search history.

(56) References Cited

U.S. PATENT DOCUMENTS

| | | | | |
|---|---|---|---|---|
| 2,220,186 | A * | 11/1940 | Walker | 220/627 |
| 2,751,672 | A | 6/1956 | Reed | |
| 2,866,261 | A | 12/1958 | Macku | |
| 3,182,958 | A | 5/1965 | Peterzon-Arbella | |
| 3,380,147 | A | 4/1968 | McDonald | |
| 4,047,700 | A | 9/1977 | Koller | |
| 4,067,097 | A | 1/1978 | Okamoto | |
| 4,078,295 | A | 3/1978 | Koller | |
| 4,121,747 | A | 10/1978 | McFatter | |
| 4,177,915 | A | 12/1979 | Blankenburg | |
| 4,494,291 | A | 1/1985 | Morrison | |
| 2004/0124226 | A1 | 7/2004 | Morrison | |

* cited by examiner

*Primary Examiner*—Kevin P Kerns
*Assistant Examiner*—Megha Mehta
(74) *Attorney, Agent, or Firm*—James Creighton Way

(57) ABSTRACT

Large tanks are built by welding pre-formed plates in operations near the ground. An annular concrete base with extended lifter pads is poured. Floor plates are lifted using lifting nuts, are placed on compacted sand and river gravel and are welded laterally. Peripheral templates are welded to the floor. Nested pre-curved plates are transported vertically. Forklifts move the plates using cleats, yokes and turntables. Pre-curved plates are welded vertically, forming a first ring. A roof is built on and welded to the first ring. The first ring and roof are lifted with self-climbing hydraulic lifters on lifting pillars. Additional rings are assembled in sequences of plate positioning, vertical welding, lowering the above structure using guides and spacers, horizontal welding, lifting, repeating the steps, and finally welding the bottom ring to the floor.

29 Claims, 11 Drawing Sheets

STORAGE TANK CONSTRUCTION

BACKGROUND OF THE INVENTION

Large storage tanks are well known. Warping problems arise when transporting, positioning and welding plates. Building tanks from the ground up requires cranes and high scaffolds for workmen and welders.

Needs exist for new methods and apparatus for building large storage tanks.

SUMMARY OF THE INVENTION

In the workshop plates are produced, with great accuracy, in pieces as big as possible for transportation.

Transverse welds are made to elongate floor plates. The floor plates are arranged side by side and the circular peripheries cut, all at the workshop. The tank base is prepared by clearing, excavating and compacting soil. Annular forms are constructed and a reinforced concrete base and radial lifter support pads are poured. The forms are removed and layers of sand and river gravel are compacted within the annular concrete base.

On the site the floor plates are assembled and welded along longitudinal side edges as the bottom. The floor is used as a base for welding peripheral templates, on which the shell rings are assembled and welded. Pre-curved plates for forming the top shell ring are placed on the templates and are welded together along vertical seams.

The roof is assembled and welded. Details are in co-pending patent application Ser. No. 10/956,351, which is incorporated herein by reference in its entirety.

The roof is welded to the upper circular edge of the top shell ring.

The whole top ring and roof is lifted with hydraulic jacks on lifting pillars, sufficiently high to install the pre-curved plates for forming the next shell ring on the templates. Vertical seams of the second shell ring are welded. Temporary spacer guides are spot welded inside the second ring. The top shell ring is moved down to fit in the guides and on the spacers attached to the second rings. The upper edge of the second ring is welded to the lower edge of the first ring. The process is then repeated.

The last or bottom shell ring is assembled and vertically welded, then is welded to the next above ring. Finally the bottom ring is welded to the floor.

A concrete base ring surrounds compacted soil, sand and river gravel layers. A floor is built on top of the concrete ring.

Lifting nuts made of weldable steel are welded temporarily to flat floor and roof plates. That makes it possible to lift, move or position the plates whether they are thick, thin or irregular. The plates may be lifted in many points with a yoke and chains connected to bolts in the lifting nuts.

An open transport support is constructed as a beam platform. Three double pillars are attached to the beams to vertically hold and transport the pre-curved plates that conform the shell rings. The plates are maintained in a vertical position as they go into the tank from the time that they are rolled. That maintains the accuracy of the curvature, and is safer.

A special yoke with a turntable is used to move or position the curved shell plates vertically as they go into the tank. The yoke has a lifting ring in the top center, to be lifted with a crane. In the bottom center of the yoke a turntable has a base to be taken with a forklift. Both ends of the yoke have slots to fit cleats that are temporarily welded to the interior of a curved plate. To be stable and vertical, the center line that connects the two joining points must cross over the vertical center of gravity of the curved plate.

To make the tank floor as flat as possible, only longitudinal welding is carried out on site.

The bottom of the tank is used as a template by means of a series of special template devices temporarily welded along the perimeter about every twenty inches.

To avoid internal tension and deformation, the vertical welding that forms each steel ring must be made when the ring is stationary, independent from the rest of the tank. In that way the reduction of the perimeter produced by the welding will not affect the rest of the shell rings or itself.

To assemble one shell ring to another, special alignment and spacer devices are used to obtain perfect assembly between the upper and lower shell rings when they join. When an upper shell ring is lowered, it is centered to the correct alignment with and to the correct gap above the lower ring.

The lifting pillars are mechanical jacks driven by hydraulic cylinders. Each structure is formed by two channel beams joined opposite by two plates. In both channel beams, one flange is serrated.

In its lower part is has a chair-type base to settle the pillar on the foundation bolts inserted in the pads formed on the concrete base.

A sliding device moving in the serrated side lifts the assembled tank rings. The sliding device has an upper part and a lower part, which are joined by a double-action cylinder. Each part has two catches which push toward each other by springs. The catches allow only upward movement. When the partially assembled tank needs to be raised, the hydraulic cylinder pushes it upward, the lower part locks it in place, and the catches prevent the tank from moving downward. The upper part of the tank can then move freely upward. When the hydraulic cylinder is pulled, the upper part of the sliding device cannot descend, and the lower part can move up freely. If the tank needs to be lowered, the hydraulic cylinder must be elongated and the upper catches are opened. When the hydraulic cylinder closes, the tank descends. That is followed sequentially by moving the lower and upper parts downward in repeated steps.

Three coordinated independent hydraulic systems drive the lifting pillars. The numbers of pillars must be a multiple of three, operated simultaneously by a common command. The system shares the load between all the lifting pillars and attains a three-point stability of the lifted tank.

A storage tank construction starts with providing a prepared base. A tank floor is built on the prepared base. Templates are mounted peripherally around the tank floor. Pre-curved plates are placed on the templates. Welding together vertical longitudinal ends of the plates complete a first cylindrical ring shell. A roof is built and welded atop the first ring. Lifters around the first cylindrical ring shell raise the first cylindrical ring shell and hold the first cylindrical ring shell in an upward position. Placing the next level of pre-curved plates on the templates and vertically welding ends of the pre-curved plates together forms a second cylindrical ring shell spaced beneath the first cylindrical ring shell. Lowering the first cylindrical ring shell near with the second cylindrical ring shell is followed by circumferentially welding lower edges of the first ring shell and upper edges of the second ring shell together. Engaging the second ring shell with the lifters and raising the second ring shell and the first ring shell provides room for constructing a lower ring. Similarly positioning pre-curved plates of sequential ring shells on the templates and welding longitudinal ends of the pre-curved plates together forms sequential ring shells. Lowering above preassembled cylindrical ring shells close to a lower ring shell, welding an upper edge of the lower ring shell circumferentially to a lower edge of the above ring shell, engaging the lower ring shell and raising the lower ring shell and the above ring shells builds the tank. Removing the templates, positioning bottom pre-curved plates in contact with the floor is followed by vertically welding the bottom pre-curved plates end-to-end and forming a bottom cylindrical ring shell. Lowering the above assembled cylindrical ring shells so that a lower edge of the lowermost above ring shell is near an upper edge of the bottom ring shell makes possible the welding the adjacent lower and upper edges circumferentially. Welding a lower edge of the bottom ring shell to the floor completes the storage tank.

The floor is built by placing elongated floor plates laterally adjacent each other on the prepared base and welding longitudinal edges of the plates together.

The templates are radially oriented plural L-shaped plates welded circumferentially around the floor for supporting the pre-curved plates vertically above the floor.

The L-shaped plates have exterior vertical members. The pre-curved plates are placed inside the vertical members.

Lower portions of the plates are locked against the vertical members with locking levers hinged on the members.

Lifting cleats are temporarily welded to insides of the vertical plates. The cleats have downward openings. Recesses in ends of a lifting yoke beam engage the vertical openings of the cleats. A center of the beam is raised with a lifting device.

The lifting device is a crane or preferably a liftable turntable mounted on a forklift.

External cleats are welded to the plates in a ring and the lifters engage the external cleats.

The number of equally spaced lifters is divisible by three.

A roof is supported on and is welded to an upper edge of a first uppermost cylindrical ring shell after the first cylindrical ring shell is completed and before the first cylindrical ring shell is lifted.

The roof may be a dome roof.

Preferably the roof is a conical roof.

To construct the conical roof, support tables are placed inside the first ring. Elongated plates are placed on the support tables and extend over the ring. Welding longitudinal edges of elongated plates leaves an open sector having radial edges in the flat plate. Raising the center of the flat plate closes the sector by abutting the radial edges of the sector. The juxtaposed radial edges are welded together and peripheral parts of the roof are welded to the upper edge of the first ring.

Initially spot welding the templates at intervals across the laterally welded elongated plates before lifting the center of the roof and fully welding the radial beams to the cylindrical roof after lifting the center of the roof strengthens the roof.

The radial beams terminate at uniform distances spaced from the center of the roof. Welding a compression ring to inner ends of the beams adds strength. Welding a lower surface of the roof to an upper edge of the first cylindrical ring shell completes the roof before the first cylindrical ring shell is lifted.

Pre-curved plates of increasing thickness form the sequentially lower cylindrical ring shells.

Lateral shims are provided between vertical members of the templates and the pre-curved plates when forming the first cylindrical ring shell. Shims of reduced thickness are provided when forming subsequent cylindrical ring shells with plates of increased thickness.

The forklift remains within the tank structure as each cylindrical ring shell is completed and lifted. The forklift exits the structure before pulling a last end of a last pre-curved plate of the bottom cylindrical ring shell into position to complete the bottom ring shell.

Pre-curved pre-formed plates are placed on a support between plural pairs of columns. Lifting the loaded support onto a truck trailer, delivering pre-formed plates on the support and truck trailer and off-loading the loaded support at the site preserves and protects the plate curvatures. Loading is in an order reversed from that in which the pre-formed pre-curved plates are to be used in the first and subsequent rings.

A reinforced concrete ring base has anchor pads for the lifters. Compacted soil is overlayed by compacted sand and river gravel layers within the concrete ring base. The tank floor elongated plates are placed on the top of the river gravel, sand and compacted soil layers before welding longitudinal edges of the plates, completing the tank floor.

The lifters have climbing sliding members with hydraulic rams therebetween. Teeth extend from the members for locking with a stepped beam extending upward within the lifters.

Vertically rolled horizontally curved vertical plates are placed in alignment on a support base. Holding the plates on the support base between pairs of columns, clamping tops of the pairs together, and urging the plates from first columns in the pairs toward second columns in the pairs rigidifies the plates and protects their curvature. Lifting the support base onto a truck trailer, transporting the trailer and the support base with the plates to a tank construction site, lifting the support base from the trailer and placing the support base near the tank construction site maintains plate curvatures. The plates are lifted individually from the support base and placed into position above the tank floor.

Vertical templates having L-shaped tops with legs extending upward along outer surfaces of the pre-curved plates. Clamps have first ends pivoted on sides of the templates remote from the legs. Sloped second free ends of the clamps are placed against inner surfaces of the pre-curved plates. Wedging the pre-curved plates in place against the legs of the templates occurs by downward blows on the clamps. Welding vertical seams between adjacent ends of the panels forms a ring of panels. After welding tops of the panels to bases of the next above structure, the clamps are released by upward blows on the clamps.

Spot welding horizontal bridges over the vertical ends of the panels and welding vertical supports on the bridges and on one of the plates before welding the vertical seams maintains ring size.

Laminated guide spacers are spot welded near an edge area of one of the ring of panels, the guide spacers having straight inward vertical edges for spot welding to surfaces of one of the rings and sloping surfaces for guiding the other ring. Spacers extend between the sloping surfaces and the straight edges for spacing the horizontal edges of the adjacent rings of panels during welding of the edges together.

The building of the tank floor further includes forming elongated floor panels, laterally, assembling the longitudinal floor panels and forming a circular floor edge on the floor panels, welding lifting nuts to the elongated panels, welding clevises to upper ends of threaded connectors, engaging the lifting nuts with the welded connectors and lifting the clevises on the threaded connectors with chains, a yoke and a crane, placing the elongated panels on the prepared base, welding longitudinal side edges of the elongated plates together, and removing the lifting nuts.

Preferred lifters have back-to-back channel beams separated by welded plates. Opposite flanges are shaped with triangular edges with flat upper surfaces. Climber frames have upper and lower gripper members. Each member partially surrounds the opposite shaped flanges. Oppositely inwardly urged detents engage the flat upper surfaces and override the sloped triangular edges. A double-acting cylinder and piston connected between the upper and lower gripper members successively extends and withdraws the piston and thereby sequentially raises the upper and lower gripper members.

These and further and other objects and features of the invention are apparent in the disclosure, which includes the above and ongoing written specification, with the claims and the drawings.

DETAILED DESCRIPTION OF THE PREFERRED EMBODIMENTS

Figure 1:
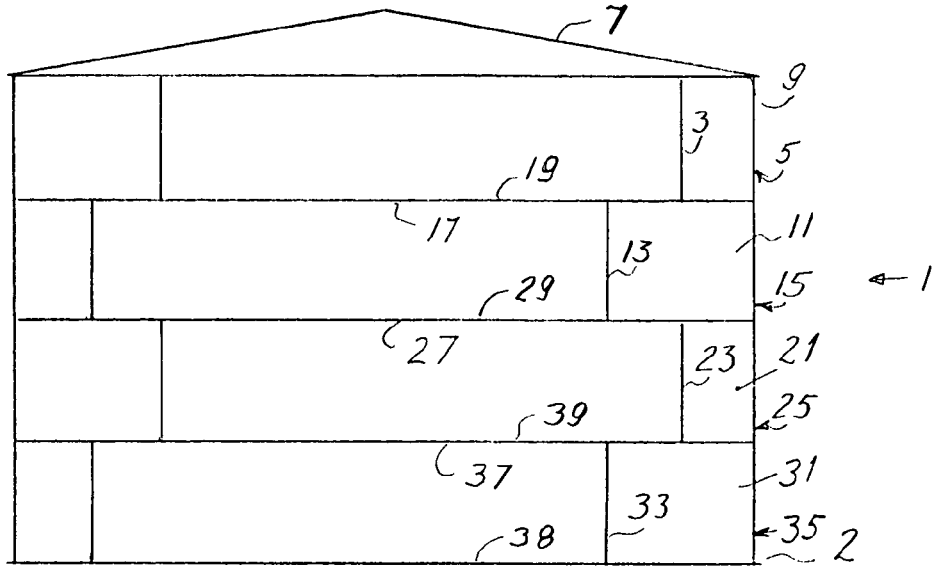
FIG. 1 is an elevation of a tank constructed according to the present invention.

FIG. 1 is an elevation of a tank constructed according to the present invention. Tank 1 is built so that all the construction and welding occurs near the ground level 2. First the upper ring 5 of curved plates is assembled on templates on the base, then the plates are welded vertically 3. A triangular roof 7 is assembled on and welded to the upper edge 9 of the upper ring 5. Next, the upper ring 5 is lifted by multiple lifters to provide sufficient clearance to insert curved plates 11, which form the next lower ring 15 by vertically welding 13 end edges of plates 11. The upper edge 17 of ring 15 is then welded to the lower edge 19 of ring 5. External lifters are attached to external cleats on the outer surface of ring 15. The lifters lift ring 15, ring 5 and roof 7 to make room for placing plates 21 beneath ring 15. When the plates 21 are in place and clamped against the templates, vertical seams 23 between the plates are welded, and ring 25 is formed. The upper edge 27 of ring 25 is then welded to the lower edge 29 of ring 15. External cleats are welded to outer surfaces of ring 25 at spaced locations, and lifters engage the cleats to lift ring 25, ring 15, ring 5 and roof 7 sufficiently high to allow installation of plates 31. Plates 31 are placed in position on templates or on the floor against external guides. When all of the plates 31 are assembled, vertical seams 33 are welded, forming the bottom ring 35. Then the above rings 25, 15, 5 and roof 9 are lowered until the lower edge 39 of ring 25 is positioned just above the upper edge 37 of ring 35. Then the edges 37 and 39 are welded, followed by welding lower edge 38 of ring 35 to floor 2, completing the overall construction of the tank body.

Figure 2:
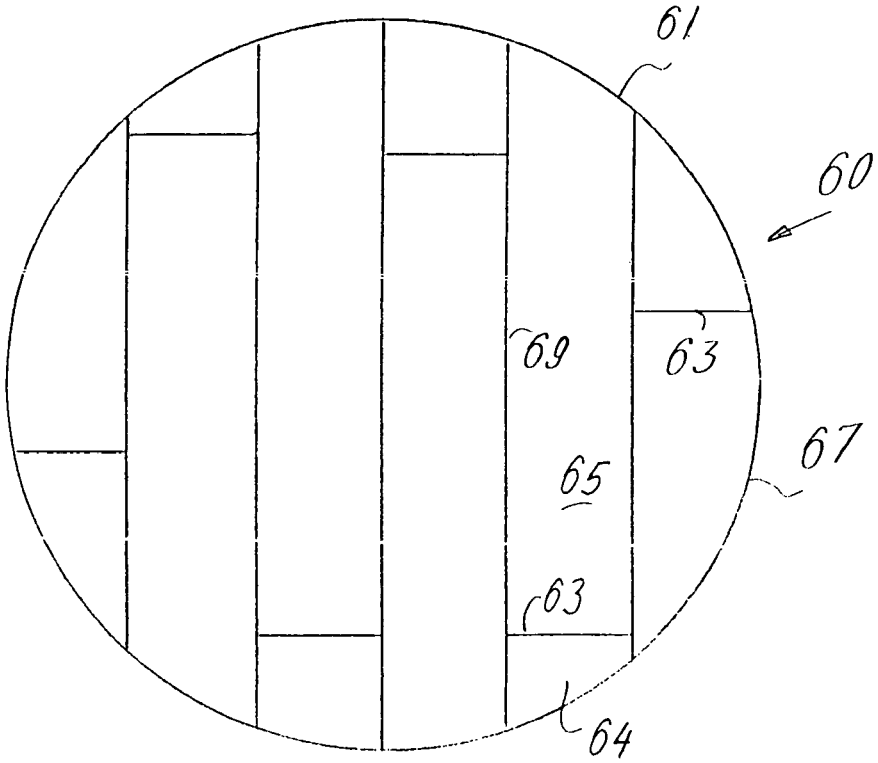
FIG. 2 is a plan view showing construction of the floor.

FIG. 2 is a plan view showing construction of the floor. As shown in FIG. 2, a base 60 is made up of multiple elongated plates 61. Some of the plates have transverse seams 63 welded between sections 64 and 65 prior to placement on the base.

Elongated panels 61 are welded transversely 63 off site and are assembled, held together and peripherally cut 67 off site. The panels 61 are then transported to the site and moved to the prepared base, where they are reassembled and welded along longitudinal seams 69. The welding along longitudinal seams 69 is the only welding that takes place in the floor on the site. That prevents wrinkling and grooving of the welded plates at intersections of the welds 63 and 69, which would occur if all of the welds were performed on site.

Figure 3:
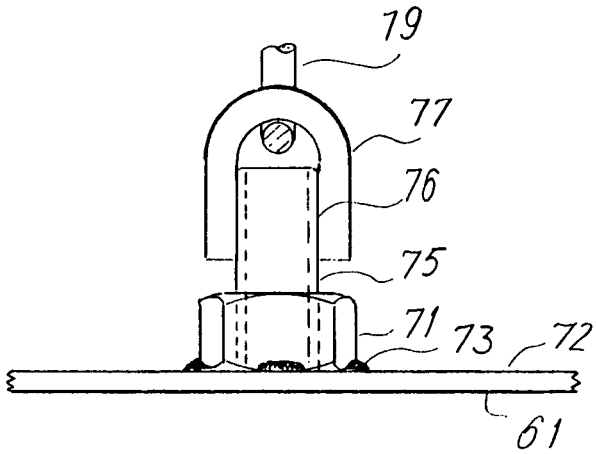
FIG. 3 shows lifting nuts connected to floor panels.

FIG. 3 shows lifting nuts connected to floor panels.

Because the plates 61 are thin and flexible, they are lifted and positioned in place with lifting nuts 71, which are spot welded 73 to the tops 72 of the plates 61. Threaded connectors 75, in this case all threads, are welded 76 to loops or bails 77, which are attached to chains 79. The all threads or bolts 75 are engaged with the lifting nuts 71 and lifted with chain 79 uniformly across the plates 61 to prevent bending or warping of the plates while lifting the plates into position for assembly as the floor 60 on site on the prepared base. After the longitudinal welds 69 are completed, the spot welds 73 are ground off and the lifting nuts 71 are removed from the upper surfaces 72 of plates 61.

Figure 4:
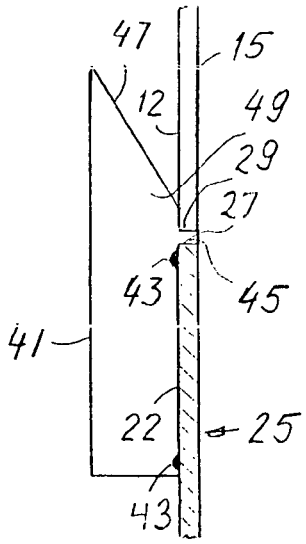
FIG. 4 is a partial cross-section showing guide spacers used in assembly of the curved side panels prior to welding.

FIG. 4 is a partial cross-section showing assembly of the curved side panels prior to welding.

As shown in FIG. 4, spacer and guides 41 are spot welded 43 at numerous positions along the internal wall 22 of ring 25. The spacers have projections 45 which fit between edges 27 and 29 of rings 25 and 15, and have sloped guiding surfaces 47 which guide the upper rings as they are lowered. Internal wall 49 of the guide and spacer 41 correctly position the internal wall 12 of the ring 15 to properly align ring 15 with ring 25.

The proper spacing between edges 27 and 29 is maintained by the projections 45 from the guides and positioners 41. External welds are applied between the spaced edges 27 and 29, and projections 45 are consumed in the welding. Then the guides 41 are knocked off with hammer blows and any debris between the edges 27 and 29 is ground away, and the internal welds between the edges 27 and 29 are made.

Figure 5:
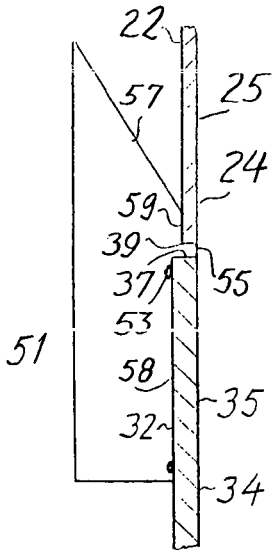
FIG. 5 shows assembly of an upper thinner curved plate to a lower thicker curved plate using especially configured guide spacers and locators spot welded to the lower plate.

FIG. 5 shows assembly of an upper thinner curved plate to a lower thicker curved plate using especially configured guide spacers spot welded to the lower ring. As shown in FIG. 5, guide spacer 51 is spot welded 53 to the interior 32 of bottom ring 35. Spacers 55 extend between the lower edge 39 of upper plate 25 and the upper edge 37 of the bottom plate 35. Because the bottom plate 35 is thicker than the upper plate 25, interior surface 59 of the guide is spaced outward from the interior surface 58 of the guide 51, which lies along the interior surface 32 of ring 35. The outward positioning of guide surface 59 ensures that the outer surfaces 24 and 34 of rings 25 and 35 are maintained in a straight line. The upper sloping surface 57 assures the proper centering of the upward assembly as it is lowered into position adjacent the bottom ring.

Figure 6:
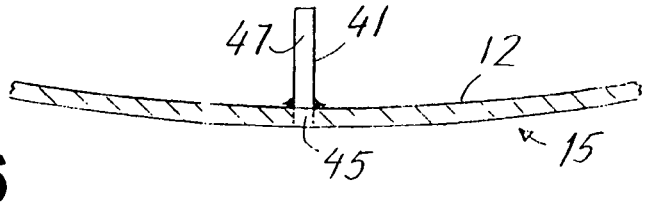
FIG. 6 is a plan view detail showing the upper plate partially in cross-section mounted on one guide spacer.

FIG. 6 is a plan view showing the upper ring partially in cross-section mounted on one guide spacer. FIG. 6 shows a top view of the structure shown in FIG. 4, with the upper ring 15 shown in cross-section. The guide spacers 41 may be made of thin laminated sheets.

Figure 8:
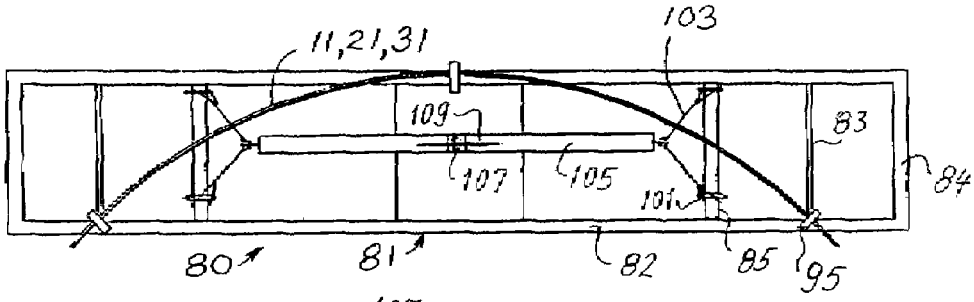
FIG. 8 is a plan view of the support and curved plates.
Figure 7:
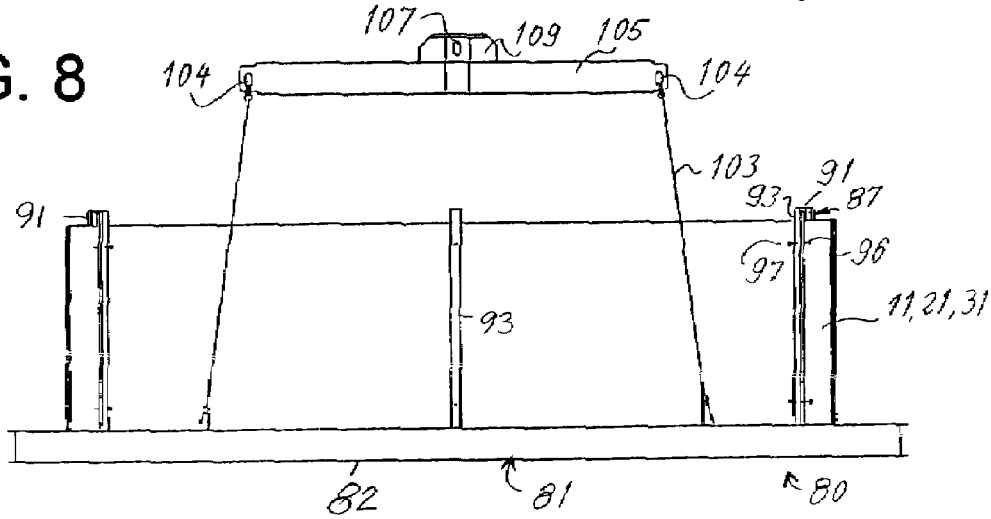
FIG. 7 is a side elevational view of curved tank construction plates mounted on a transportable plate support.

FIG. 7 is a side elevational view of curved tank construction plates mounted on a transportable plate support. FIG. 8 is a plan view of the support and curved plates. FIGS. 7 and 8 show supports 80 for transporting the tank-building curved plates 11, 21, 31 from off site vertical rolling equipment to the tank-erecting site. Support 80 has a base 81 made of welded side and end channel beams 82, 84 and cross members 83. Lifting tubes 85 are welded between side beams 82. Double columns 87 extend upward from the base for holding the pre-curved plates 11, 21, 31 rigidly in a vertical position while transporting the plates from the off site rolling machinery to the erection site. The double columns have outer members 91 and inner members 93, and the pre-curved plates are held between the outer and inner members. Caps 95 hold upper ends of the columns 91 and 93 together. Lower ends of the columns are welded to the side beams 82. Bolts 97 with flat ends 96 are tightened to secure the plates in place. Collars 101 are connected to cross tubes 85, and lifting cables 103 have lower ends looped around the cross tubes 85 outside of the collars. Upper ends of cables 103 are connected to holes 104 at ends of yoke 105. The center of the yoke has a lifting opening 107 reinforced with gussets 109. In use, the support 80 is placed near the vertical rolling machinery. Plates are transferred directly from the vertical rolling machinery to the support and are placed between the columns 91 and 93. When the support is filled to capacity with the plates, caps 95 are positioned over upper ends of the supports, and bolts 97 are turned inward to hold the plates in fixed position. Cables 103 are then connected to the lifting tubes 85 outside of the collars 101, and the support 80 is raised by a crane and placed on a flat bed trailer. The trailer is hauled to the site, the lifting yoke 105 and cables 103 are again attached to the lifting tubes 85 outside of the collars 101, and a crane lifts and deposits the support 80 close to the prepared tank building site. The cables 103 and yoke 105 are removed. Caps 95 are removed and bolts 97 are loosened.

Figure 10:
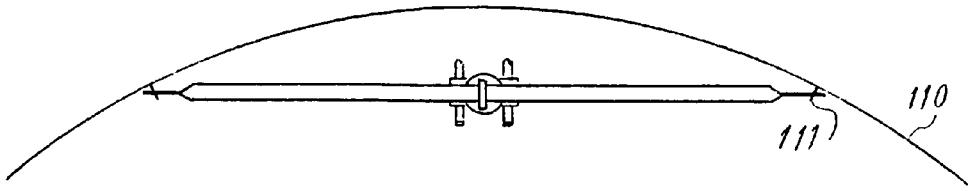
FIG. 10 is a plan view of a forklift yoke showing the lifting arms and turntable.
Figure 9:
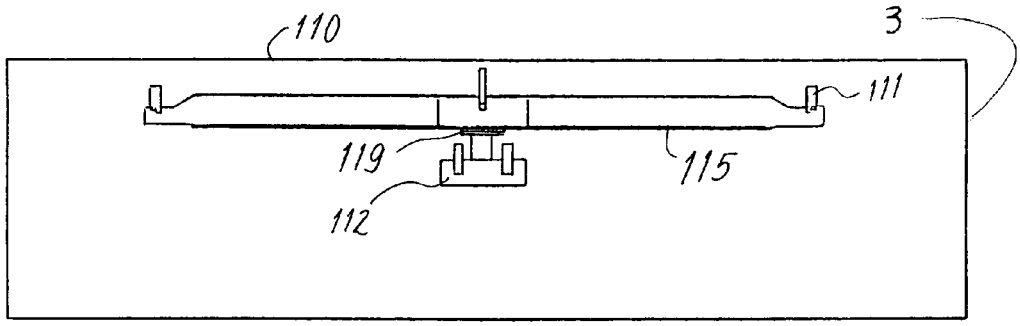
FIG. 9 is an elevational view of a curved plate supported on a turntable yoke which is raised, moved and lowered by a forklift.
Figure 11:
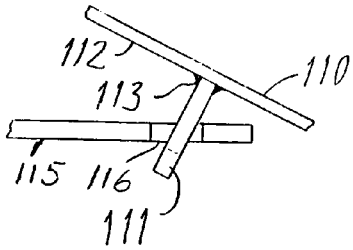
FIG. 11 is a detail of an inner lifting cleat being engaged by one end of the forklift yoke lifting arm shown in top view detail.
Figure 12:
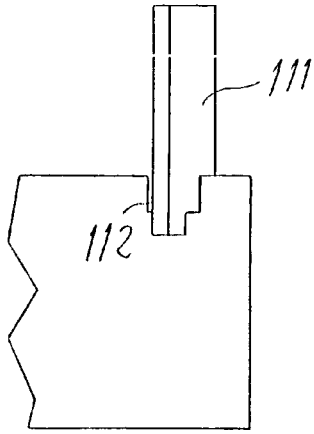
FIG. 12 is a side view detail showing engagement of an interior plate-lifting cleat by an end of the forklift yoke arm.

FIG. 9 is an elevational view of a curved plate supported on a yoke which is raised, moved and lowered by a forklift. FIG. 10 is a plan view of a forklift yoke showing the lifting arms and turntable. FIG. 11 is a detail of an inner lifting cleat being engaged by one end of the forklift yoke lifting arm shown in top view detail. FIG. 12 is a side view detail showing engagement of an interior plate-lifting cleat by an end of the forklift yoke arm.

As shown in FIGS. 9-12, interior plate-lifting cleats 111 are spot welded 113 to interior surfaces 112 of the innermost pre-curved plate 110 of the nested pre-curved plates on the support. Yoke 115 on a forklift has end depressions 116, which engage the interior lifting cleats 111. Forks of a forklift are placed through openings in base 117 of turntable 119 at the center of the yoke 115. The forklift lifts the innermost plate clear of the inner vertical columns 93 and carries the innermost plate to an appropriate position on templates assembled around the peripheral area of the floor. The forklift lowers the plate into a predetermined position on the templates, and clamps on the templates are raised to clamp the pre-curved plate 110 into position on the templates. Lowering the forklift releases the depressions 116 in ends of the yoke from the interior lifting cleats 111, and the forklift returns to the support 80 for lifting the next innermost shell 110, to which interior lifting cleats 111 have been welded. The forklift completes the carrying of a number of pre-curved plates 110 into place on the templates until the ring is complete. Welding vertical edges 3 of the plates completes one of the rings.

In all but the final bottom ring, the forklift remains within the ring until the ring and above rings and roof are lifted by the lifters. The bottom ring is assembled just as the other rings are assembled, with the exception that the final plate of the bottom ring is carried into position by the forklift driving within the structure. One vertical edge of the final plate is aligned with the next adjacent vertical edge of a plate which is already in position, and the forklift continues to move the pre-curved plate outward until a gap is left between the other end of the final pre-curved plate and the end of the plate adjacent the other end. The forklift then lowers the plate onto the templates and exits from the floor of the tank through the gap. Pulling outward on the end of the last plate from outside the tank places the last plate into the last ring. The turntable under the lifting yoke enables the disengaged yoke to be aligned with the forklift as it drives outward through the gap.

Before placing the plates in position for forming the bottom ring, the templates may be removed and replaced with alignment blocks. The bottom plates may be placed directly on the floor.

Figure 13:
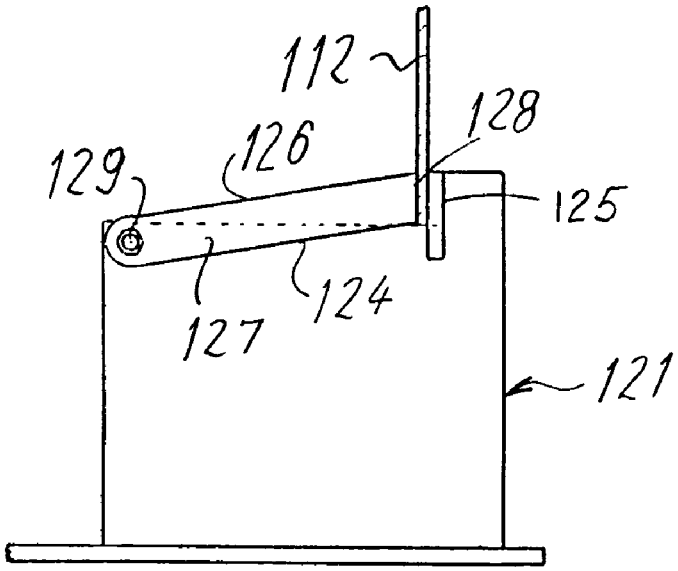
FIG. 13 is a side elevational view of one of many templates which are welded in radial directions near a periphery of the floor, and showing a clamping arm engaging a plate shown in cross-section and urging the plate against an outward stop on the template.
Figure 14:
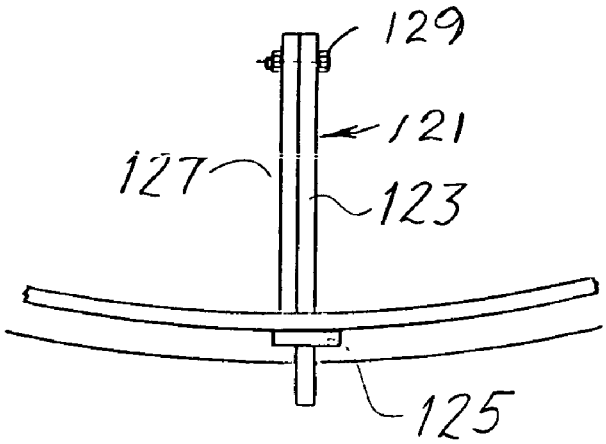
FIG. 14 is a plan view of the radial clamp lever hinged with a bolt to the template.

FIG. 13 is a side elevational view of one of many templates which are welded in radial directions near a periphery of the floor. A clamping arm engages a plate shown in cross-section and urges the plate against an outward stop on the template. FIG. 14 is a plan view of the radial clamp lever hinged with a bolt to the template.

FIGS. 13 and 14 show one of the many templates and clamps which are aligned radially. The templates 121 are thin vertical plates. Each has a horizontal surface 123 which supports the plates, and an outward stop 125 which prevents excessive outward movement of the plate. The stop 125 is a grooved shim in a preferred embodiment. A clamp 127 is an arm which is pivoted by a bolt 129 at one end. The arm has a sloped outer surface 128 which bears against the inner surface 112 of the plate. A blow on the top 126 of the clamp secures the plate in position. When it is time to release the clamp, a blow on the under surface 124 of the arm releases the clamp, which is rotated counterclockwise, as shown in FIG. 13, to release the completed ring for raising.

Figure 15:
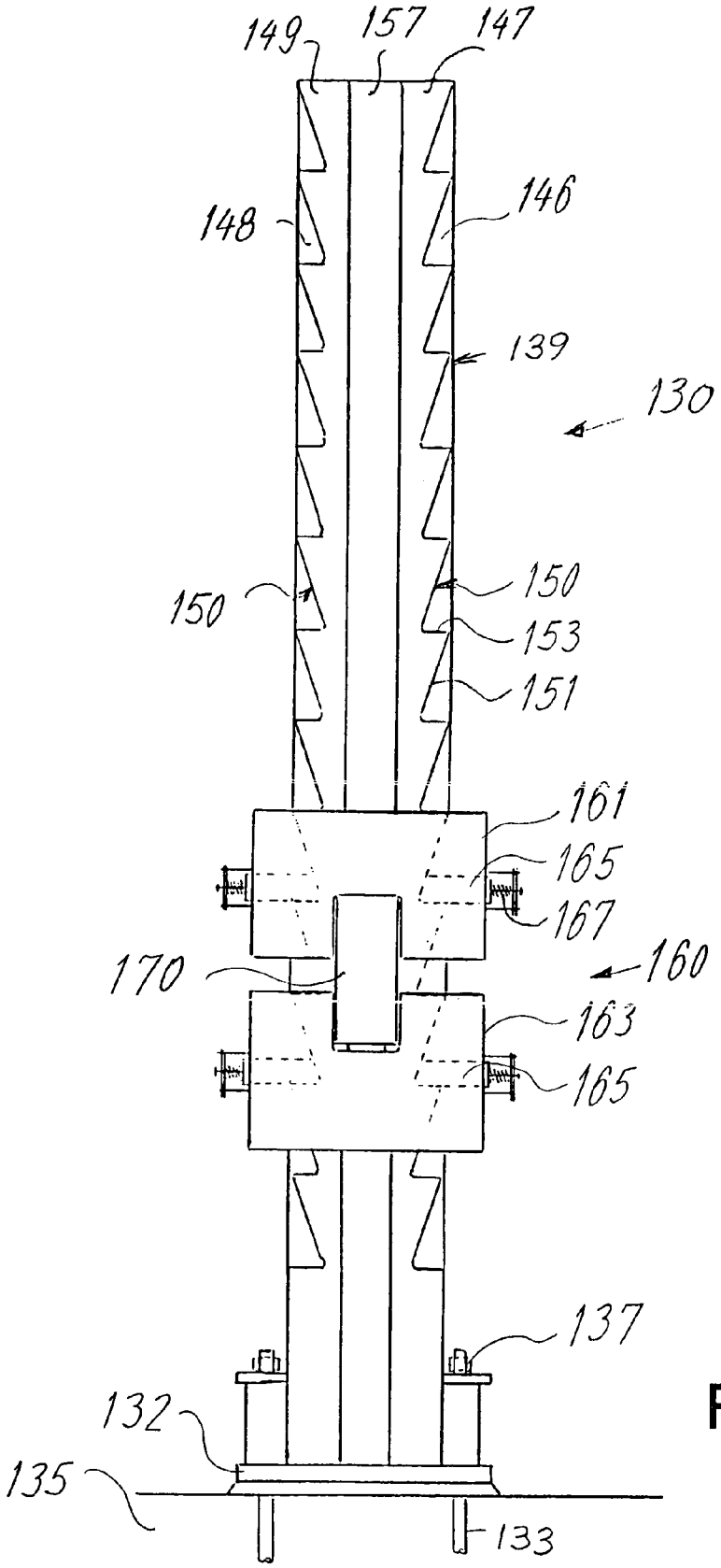
FIG. 15 is a front elevational view of a tank assembly lifting jack.

FIG. 15 is a front elevational view of a tank assembly lifting jack.

Figure 16:
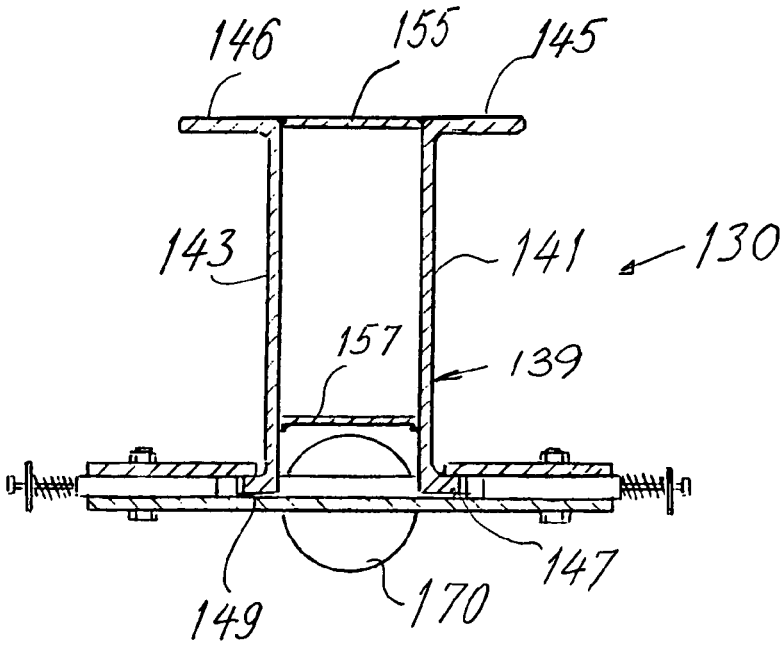
FIG. 16 is a top plan view of the lifting jack, showing the back-to-back channel beam or hollow I-beam construction of the vertical member and the spring-loaded detents on the upper climber, which is also shown partially in cross-section.

FIG. 16 is an elevational view of the lifting jack showing the back-to-back channel iron or hollow I-beam construction of the vertical member and the spring-loaded detents on the upper climber, which is also shown partially in cross-section.

Lifter 130 has a column or pillar 139 with a base plate 132 which is connected to an annular concrete base 135. Bolts 133 secured in the cement base 135 are engaged by nuts 137 to hold the pillar firmly in place.

As shown in FIGS. 15 and 16, the column 139 is formed of first and second back-to-back channel beams 141 and 143 having opposite flanges 145 and 146 at one end, and opposite flanges 147 and 149 at the opposite end. Flanges 147 and 149 have serrated edges 150 with upward and outward sloping triangular surfaces 151, and flat horizontal surfaces 153. Cross members 155 and 157 are welded between the opposite channel beams 141 and 143.

A climber frame 160 has upper and lower members 161 and 163. Each of the climber members has detents 165 urged inward by springs 167 to grip the flat surfaces 153 of the serrated flanges 150. A double-acting hydraulic actuator ram 170 is connected between the upper and lower climber members 161 and 163. As the double-acting hydraulic cylinder is extended, the upper member 161 is pushed upward, compressing springs by moving the grippers 165 outward until the next horizontal surface 153 is reached, whereupon the grippers are moved inward by springs 167 to engage the flat surfaces 153. The next operation of the ram is a pulling operation, which draws the lower climber member 163 upward in a similar operation of the gripper members 165 on the lower climbing member 163.

Lifters 139 are always arranged in three so that there are three, six, nine, twelve . . . twenty-one or more lifting pillar positioned on pads around the tank base.

Figure 17:
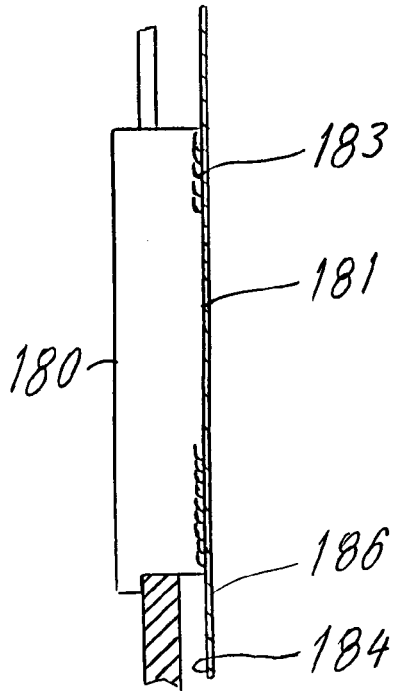
FIG. 17 is a side elevation of an externally mounted cleat on a curved plate of a tank, which is shown in cross-section. A top of a climbing member shown in cross-section engages a bottom of the cleat.

FIG. 17 is a side elevation of an externally mounted cleat on a curved plate of a tank, which is shown in cross-section. A relatively thick climbing member which engages a bottom cleat is also shown in cross-section. FIG. 17 shows an external surface cleat 180 having a base edge 181 welded 183 to an outer surface 184 of a tank construction ring 186.

Figure 18:
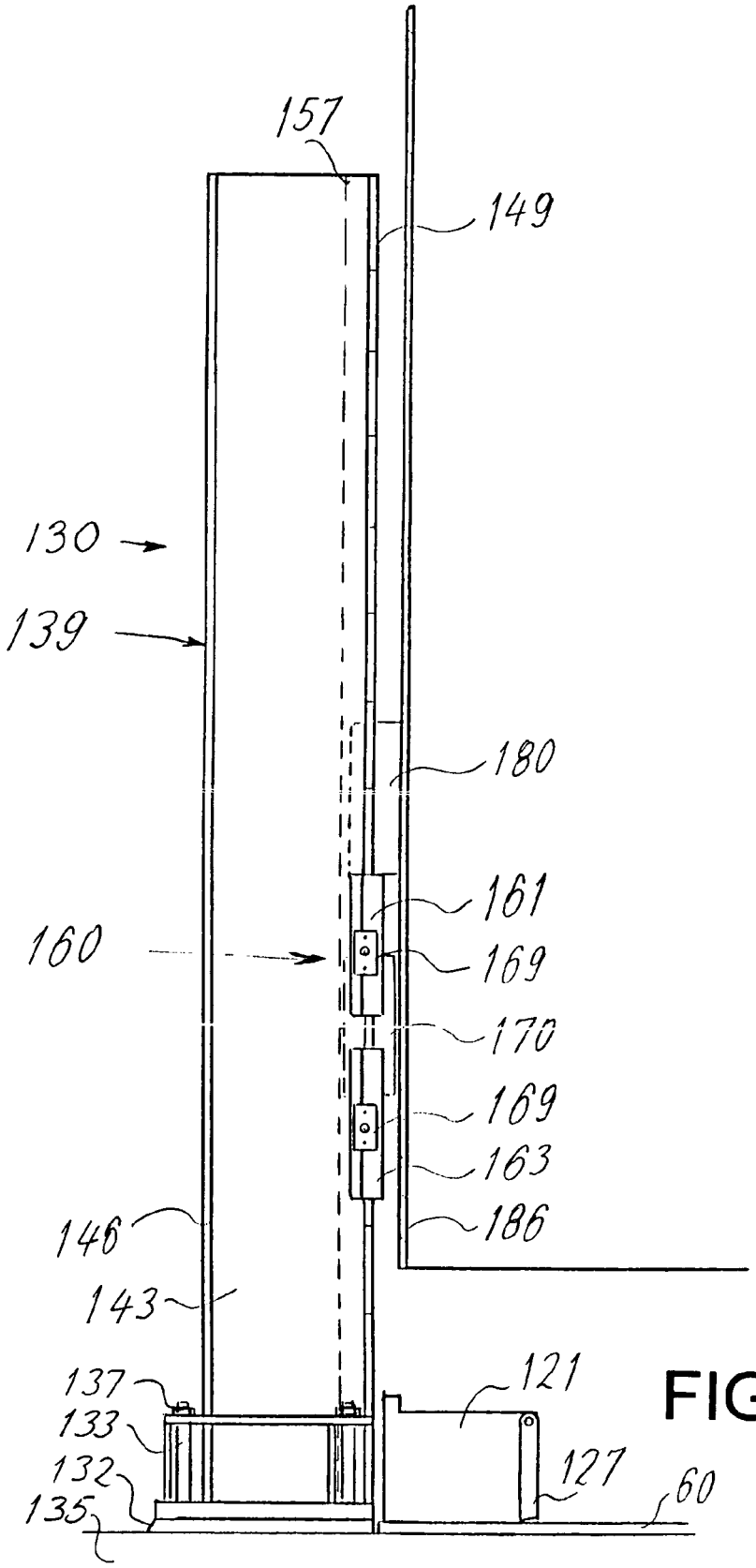
FIG. 18 is a side elevation of the lifter showing the hollow I-beam anchored at its base to the annular foundation pad extending from the base of the tank. A hydraulic cylinder alternatively pushes the upper plate upward and pulls the lower plate upward to raise the ring and the partially assembled tank in preparation for inserting additional curved plates to be vertically welded for forming a lower ring.

FIG. 18 is a side elevation of the lifter showing the hollow I-beam anchored at its base to the annular foundation pad of the tank, and showing a hydraulic cylinder for alternatively pushing the upper plate upward and pulling the lower plate upward to raise the next-above ring and the tank in preparation for inserting additional curved plates to be welded under the above welded ring.

As shown in FIG. 18, ring 186 has been partially lifted by the lifters 160. External lifting cleat 180 is engaged by the upper lifter 161, which is positioned near the tank ring 186.

Figure 19:
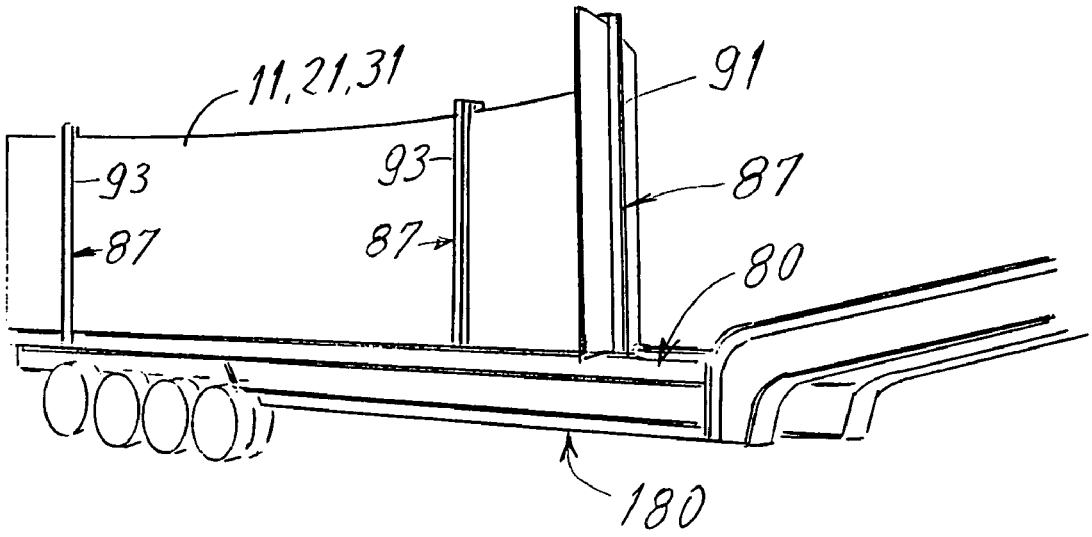
FIG. 19 shows a support and pre-curved plates mounted on a heavy duty truck trailer.

FIG. 19 shows a support and pre-curved plates mounted on a heavy duty truck trailer.

FIG. 19 shows a truck trailer 180 on which support 80 is mounted for holding the pre-curved tank plates 11, 21, 31 between the vertical columns 87. The outer columns 91 and the inner columns 93, which are connected to the support 80, are also shown in FIG. 19.

Figure 20:
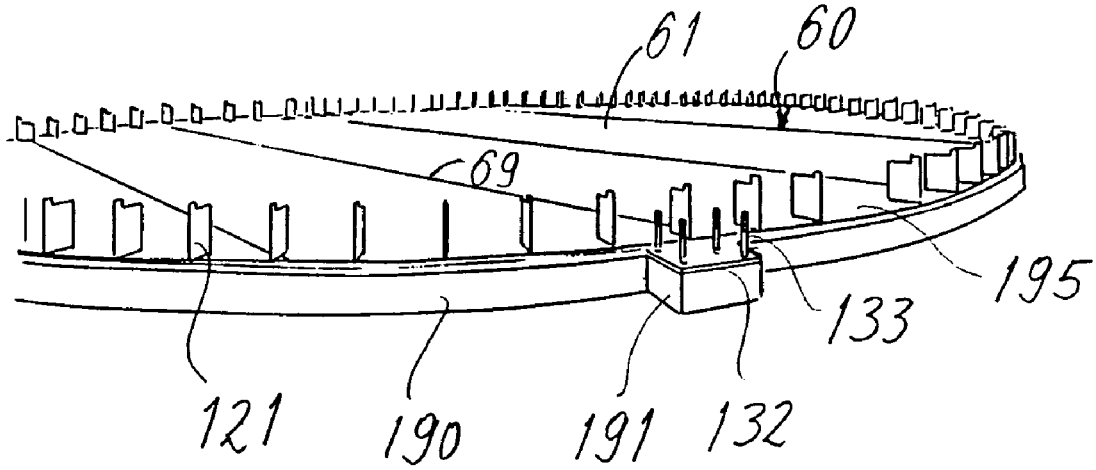
FIG. 20 shows templates radially attached to peripheral areas of a floor and a lifter base pad integrally formed with the cement base.

FIG. 20 shows templates radially attached to peripheral areas of a floor and a lifter base pad integrally formed with the cement base.

FIG. 20 shows an annular concrete base 190 which has been prepared with integrally extended lifter pads 191 at several places around the periphery of the annular concrete base 190. The lifter pads 191 occur in at least three places or in multiples of three places around the concrete base. A base plate 132 is attached to each pad, and bolts 133 are embedded in each pad. Floor 60 is constructed by assembling pre-cut elongated plates 61 on the annular base and pre-compacted soil and compacted sand and river stone or asphalt layers within the base, and laterally welding 69 the plates 61. Templates 121 are welded to a peripheral area of the floor 60 at intervals of about 20 inches. A gap 195 between adjacent templates is left so that a forklift truck, which carries the pre-curved plates into the structure for forming the rings, can drive into and out of the structure.

Figure 21:
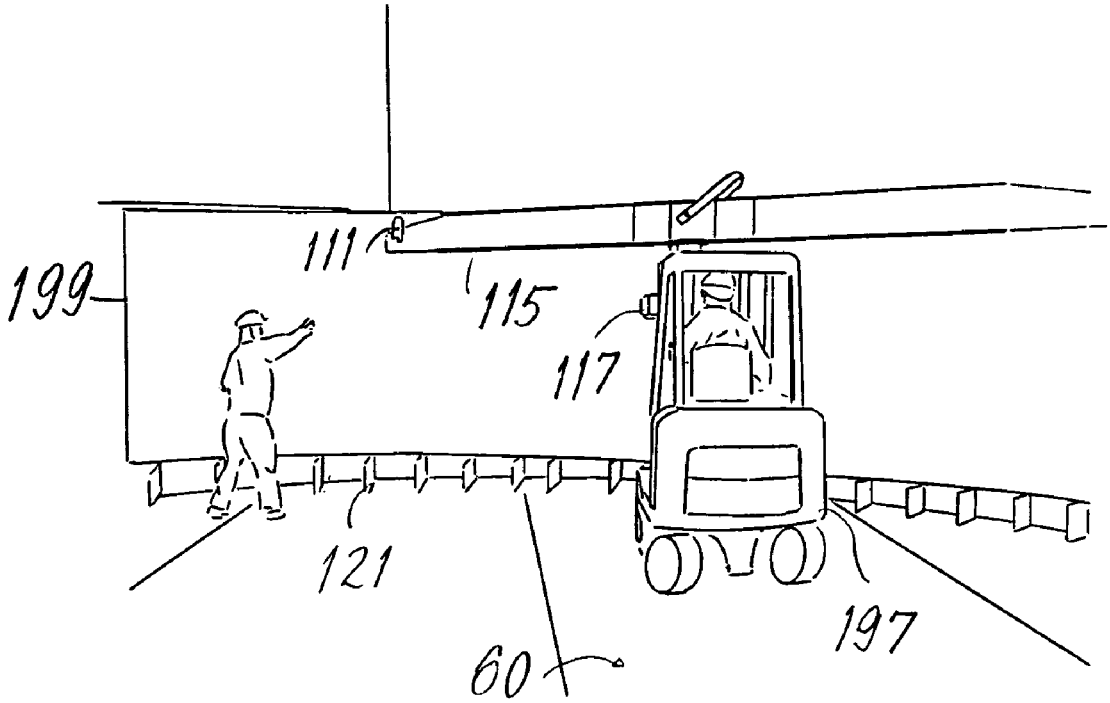
FIG. 21 shows a forklift truck with a yoke on a turntable positioning a pre-curved plate on the templates.

FIG. 21 shows a forklift truck with a yoke on a turntable positioning a pre-curved plate on the templates.

FIG. 21 shows a forklift truck 197 within the structure on floor 60 positioning a plate 199 on the templates 121 with the help of a worker. Forks of the forklift engage the base 117 of the turntable for raising and lowering yoke 115, which has recesses in its end for engaging interior cleats 111 welded to interior surfaces of plate 199. When all of the plates necessary for constructing one ring are positioned, the forklift truck 197 remains within the structure while vertical welds along vertical edges of the plates in that ring are welded to form the ring. After the lifters raise the ring in the above structure, the forklift drives off the floor 60 to return with pre-curved plates for the next ring. In the final positioning of the final plate in the bottom ring, one vertical edge of the plate is positioned near the vertical edge of the adjacent plate. A gap is left between the opposite vertical edge of the plate and the next adjacent plate so that the forklift 197 may exit the structure before pulling the final plate into position.

While the invention has been described with reference to specific embodiments, modifications and variations of the invention may be constructed without departing from the scope of the invention, which is defined in the following claims.

I claim:

1. A method of storage tank construction, comprising providing a prepared base, building a tank floor on the prepared base, providing templates around the tank floor, placing pre-curved plates on the templates and welding together longitudinal ends of the plates and completing a first cylindrical ring shell, providing lifters around the first cylindrical ring shell and raising the first cylindrical ring shell with the lifters and holding the first cylindrical ring shell in an upward position with the lifters, placing pre-curved plates on the templates and welding ends of the pre-curved plates together and forming a second cylindrical ring shell spaced beneath the first cylindrical ring shell, lowering the first cylindrical ring shell near the second cylindrical ring shell and circumferentially welding lower edges of the first ring shell and upper edges of the second ring shell together, engaging the second ring shell with the lifters and raising the second ring shell and the first ring shell, similarly positioning pre-curved plates of sequential ring shells on the templates and welding longitudinal ends of the pre-curved plates together, forming sequential ring shells, lowering above preassembled cylindrical ring shells to a lower ring shell, welding an upper edge of the lower ring shell circumferentially to a lower edge of the above ring shell, engaging the lower ring shell and raising the lower ring shell and the above ring shells, removing the templates, positioning bottom pre-curved plates in contact with the floor, vertically welding the bottom pre-curved plates end-to-end and forming a bottom cylindrical ring shell, lowering the above assembled cylindrical ring shells so that a lower edge of the lowermost above ring shell is adjacent an upper edge of the bottom ring shell, welding the adjacent lower and upper edges circumferentially, welding a lower edge of the bottom ring shell to the floor and completing the storage tank, wherein the providing the templates further comprises providing the L-shaped plates with exterior vertical members, and wherein the placing of the pre-curved plates comprises placing the pre-curved plates inside the vertical members.

2. The method of claim 1, wherein the building of the floor comprises placing elongated plates laterally adjacent each other on the prepared base and welding longitudinal edges of the plates together.

3. The method of claim 1, wherein the providing templates comprises welding plural L-shaped plates circumferentially around the floor for supporting the pre-curved plates vertically above the floor.

4. The method of claim 1, further comprising locking lower portions of the plates against the vertical members with locking levers hinged on the members.

5. The method of claim 1, wherein the building of the tank floor further comprises forming elongated floor panels laterally, assembling the longitudinal floor panels and forming a circular floor edge on the floor panels, welding lifting rings nuts to the elongated panels, welding devices to upper ends of threaded connectors, engaging the lifting nuts with the threaded connectors and lifting the lifting rings on the threaded connectors with chains, a yoke and a crane, placing the elongated panels on the prepared base, welding longitudinal side edges of the elongated plates together, and removing the lifting nuts.

6. The method of claim 1, wherein providing the lifters comprises providing back-to-back channel beams separated by welded plates and having opposite flanges shaped with triangular edges and with flat upper surfaces, and providing climber frames with upper and lower gripper members, each member partially surrounding the opposite shaped flanges and having oppositely inwardly urged detents for engaging the flat upper surfaces and overriding the triangular edges and a double-acting cylinder and piston connected between the upper and lower gripper members for alternately extending and withdrawing the piston and thereby alternately raising the upper and lower gripper members.

7. A method of storage tank construction, comprising providing a prepared base, building a tank floor on the prepared base, welding together longitudinal ends of the plates and completing a first cylindrical ring shell, providing lifters around the first cylindrical ring shell and raising the first cylindrical ring shell with the lifters and holding the first cylindrical ring shell in an upward position with the lifters, placing pre-curved plates on the templates and welding ends of the pre-curved plates together and forming a second cylindrical ring shell spaced beneath the first cylindrical ring shell, circumferentially welding lower edges of the first ring shell and upper edges of the second ring shell together, engaging the second ring shell with the lifters and raising the second ring shell and the first ring shell, similarly positioning pre-curved plates of sequential ring shells and welding longitudinal ends of the pre-curved plates together, forming sequential ring shells, welding an upper edge of the lower ring shell circumferentially to a lower edge of the above ring shell, vertically welding the bottom pre-curved plates end-to-end and forming a bottom cylindrical ring shell, welding the adjacent lower and upper edges circumferentially, welding a lower edge of the bottom ring shell to the floor and completing the storage tank, wherein the providing pre-curved plates comprises connecting cleats to insides of the vertical plates, the cleats having downward openings, connecting a beam beneath the cleats and in the vertical openings of the cleats and lifting a center of the beam with a lifting device.

8. The method of claim 7, wherein the lifting with a lifting device comprises supporting a center of a beam on a liftable turntable mounted on a forklift.

9. The method of claim 8, wherein the forklift remains within the tank as each cylindrical ring shell is completed and lifted and exits the structure before the last pre-curved plate of the bottom cylindrical ring shell is moved into position to complete the bottom ring shell.

10. The method of claim 7, wherein the providing of plates further comprises welding connectors on insides of the plates near longitudinal ends.

11. The method of claim 10, wherein the connectors are bridges.

12. A method of storage tank construction, comprising providing a prepared base, building a tank floor on the prepared base, welding together longitudinal ends of the plates and completing a first cylindrical ring shell, providing lifters around the first cylindrical ring shell and raising the first cylindrical ring shell with the lifters and holding the first cylindrical ring shell in an upward position with the lifters, placing pre-curved plates on the templates and welding ends of the pre-curved plates together and forming a second cylindrical ring shell spaced beneath the first cylindrical ring shell, circumferentially welding lower edges of the first ring shell and upper edges of the second ring shell together, engaging the second ring shell with the lifters and raising the second ring shell and the first ring shell, similarly positioning pre-curved plates of sequential ring shells and welding longitudinal ends of the pre-curved plates together, forming sequential ring shells, welding an upper edge of the lower ring shell circumferentially to a lower edge of the above ring shell, vertically welding the bottom pre-curved plates end-to-end and forming a bottom cylindrical ring shell, welding the adjacent lower and upper edges circumferentially, welding a lower edge of the bottom ring shell to the floor and completing the storage tank, further comprising connecting external cleats to the plates, and wherein the engaging of the cylindrical ring shells with the lifters comprises engaging the external cleats with the lifters.

13. The method of claim 12, wherein the providing lifters comprises providing a number of lifters which number is divisible by three.

14. A method of storage tank construction, comprising providing a prepared base, building a tank floor on the prepared base, welding together longitudinal ends of the plates and completing a first cylindrical ring shell, providing lifters around the first cylindrical ring shell and raising the first cylindrical ring shell with the lifters and holding the first cylindrical ring shell in an upward position with the lifters, placing pre-curved plates on the templates and welding ends of the pre-curved plates together and forming a second cylindrical ring shell spaced beneath the first cylindrical ring shell, circumferentially welding lower edges of the first ring shell and upper edges of the second ring shell together, engaging the second ring shell with the lifters and raising the second ring shell and the first ring shell, similarly positioning pre-curved plates of sequential ring shells and welding longitudinal ends of the pre-curved plates together, forming sequential ring shells, welding an upper edge of the lower ring shell circumferentially to a lower edge of the above ring shell, vertically welding the bottom pre-curved plates end-to-end and forming a bottom cylindrical ring shell, welding the adjacent lower and upper edges circumferentially, welding a lower edge of the bottom ring shell to the floor and completing the storage tank, further comprising providing a roof supported on an upper edge of the first cylindrical ring shell after the first cylindrical ring shell is completed and before the first cylindrical ring shell is lifted.

15. The method of claim 14, wherein the providing of the roof comprises providing a dome roof.

16. The method of claim 14, wherein the providing of the roof comprises providing a conical roof.

17. The method of claim 16, wherein the providing of the conical roof comprises placing support tables inside the first ring, placing elongated plates on the support tables, welding longitudinal edges of elongated plates and leaving an open sector having radial edges in the elongated plates, and raising a center of the elongated plates and closing the sector by abutting longitudinal edges of the sector.

18. The method of claim 17, further comprising initially spot welding radial beams at intervals across the laterally welded elongated plates before lifting the center and fully welding the beams to the conical roof after lifting the center.

19. The method of claim 18, further comprising terminating the radial beams at uniform distances spaced from the center, welding a compression ring to inner ends of the beams, and welding a lower surface of the roof to an upper edge of the first cylindrical ring shell before the first cylindrical ring shell is lifted.

20. The method of claim 14, further comprising providing the pre-curved plates of increasing thickness for forming the sequentially lower cylindrical ring shells.

21. The method of claim 20, further comprising providing lateral shims between vertical members of the templates and the pre-curved plates when forming the first cylindrical ring shell, and providing shims of reduced thickness when forming subsequent cylindrical ring shells with plates of increased thickness.

22. A method of storage tank construction, comprising providing a prepared base, building a tank floor on the prepared base, welding together longitudinal ends of the plates and completing a first cylindrical ring shell, providing lifters around the first cylindrical ring shell and raising the first cylindrical ring shell with the lifters and holding the first cylindrical ring shell in an upward position with the lifters, placing pre-curved plates on the templates and welding ends of the pre-curved plates together and forming a second cylindrical ring shell spaced beneath the first cylindrical ring shell, circumferentially welding lower edges of the first ring shell and upper edges of the second ring shell together, engaging the second ring shell with the lifters and raising the second ring shell and the first ring shell, similarly positioning pre-curved plates of sequential ring shells and welding longitudinal ends of the pre-curved plates together, forming sequential ring shells, welding an upper edge of the lower ring shell circumferentially to a lower edge of the above ring shell, vertically welding the bottom pre-curved plates end-to-end and forming a bottom cylindrical ring shell, welding the adjacent lower and upper edges circumferentially, welding a lower edge of the bottom ring shell to the floor and completing the storage tank, further comprising loading the pre-formed plates on a support between plural pairs of columns, lifting the loaded support onto a truck trailer, delivering pre-formed plates on the support and truck trailer, off-loading the loaded support at the site and removing the plates from the support in an order that the pre-formed pre-curved plates are to be used in the first and subsequent rings.

23. The method of claim 22, further comprising providing a reinforced concrete ring base and providing anchor pads for the lifters on the reinforced concrete base, providing a compacted soil overlayed by compacted sand and river gravel layers within the concrete ring base, and wherein the building the tank floor comprises placing elongated plates on the top of the reinforced concrete base and the river gravel, sand layers and compacted soil and welding longitudinal edges of the plates, thereby building the tank floor.

24. The method of claim 22, wherein the lifters comprise climbing sliding members with hydraulic rams therebetween and teeth extending from the members for locking, and a stepped beam extending upward within the lifters.

25. A method of storage tank construction, comprising providing a prepared base, building a tank floor on the prepared base, welding together longitudinal ends of curved plates and completing a first cylindrical ring shell, providing lifters around the first cylindrical ring shell and raising the first cylindrical ring shell with the lifters and holding the first cylindrical ring shell in an upward position with the lifters, placing pre-curved plates on the templates and welding ends of the pre-curved plates together and forming a second cylindrical ring shell spaced beneath the first cylindrical ring shell, circumferentially welding lower edges of the first ring shell and upper edges of the second ring shell together, engaging the second ring shell with the lifters and raising the second ring shell and the first ring shell, similarly positioning pre-curved plates of sequential ring shells and welding longitudinal ends of the pre-curved plates together, forming sequential ring shells, welding an upper edge of the lower ring shell circumferentially to a lower edge of the above ring shell, vertically welding the bottom pre-curved plates end-to-end and forming a bottom cylindrical ring shell, welding the adjacent lower and upper edges circumferentially, welding a lower edge of the bottom ring shell to the floor and completing the storage tank, further comprising placing the pre-curved panels which comprise vertically rolled horizontally curved vertical plates in alignment on a support base, holding the plates on the support base between pairs of columns, clamping tops of the pairs together, and urging the plates from first columns in the pairs toward second columns in the pairs, lifting the support base onto a truck trailer, transporting the trailer and the support base with the plates to a tank construction site, lifting the support base from the trailer and placing the support base near the tank construction site, lifting the plates individually from the support base, and placing the plates into position above the tank floor.

26. The method of claim 25, wherein the templates comprise vertical templates having L-shaped tops with legs extending upward along outer surfaces of the pre-curved plates, further comprising clamps having first ends pivoted on sides of the templates remote from the legs, and having sloped second free ends for placing against inner surfaces of the pre-curved plates, and further comprising wedging the pre-curved plates in place against the legs of the templates by downward blows on the clamps, welding vertical seams between adjacent ends of the pre-curved plates, thereby forming a ring of the pre-curved plates, welding tops of the pre-curved plates to bases of the next above structure, and releasing the clamps by upward blows on the clamps.

27. The method of claim 26, further comprising placing shims between the legs and the panels.

28. The method of claim 26, further comprising spot welding horizontal bridge plates over the vertical ends of the panels and welding vertical supports on the bridge plates and one of the panels before welding the vertical seams.

29. The method of claim 26, further comprising, when the next above structure is a ring, spot welding laminated guide spacers along an edge area of one of the rings, the guide spacers having straight vertical edges for spot welding to the outer surfaces of one of the rings of panels, second straight vertical edges and sloping surfaces for guiding the other ring surfaces, and inward extending spacers between the sloping surfaces and the straight edges for spacing the adjacent edges of the adjacent rings of panels during welding of the adjacent edges together.

* * * * *